United States Patent [19]

Houle et al.

[11] Patent Number: 4,954,172

[45] Date of Patent: Sep. 4, 1990

[54] COMBINATION ANODE MOUNT AND HOT WATER OUTLET FOR WATER HEATER

[75] Inventors: Timothy H. Houle, Wauwatosa; Robert M. Schurter, Elm Grove, both of Wis.

[73] Assignee: A. O. Smith Corporation, Milwaukee, Wis.

[21] Appl. No.: 390,962

[22] Filed: Aug. 7, 1989

[51] Int. Cl.[5] ..... C23F 13/00

[52] U.S. Cl. ..... 204/197; 204/148

[58] Field of Search ..... 204/147, 148, 196, 197

[56] References Cited

U.S. PATENT DOCUMENTS

| | | | |
|---|---|---|---|
| 2,486,936 | 11/1949 | Fergus | 204/197 |
| 2,642,391 | 1/1953 | Wellman . | |
| 2,710,833 | 6/1955 | Craver | 204/197 |
| 3,558,463 | 1/1971 | Strobach et al. . | |
| 3,718,573 | 2/1973 | Bidwell | 204/197 |
| 3,864,234 | 2/1975 | Wasson | 204/197 |
| 3,867,274 | 1/1975 | Herman | 204/197 |
| 3,891,530 | 6/1975 | Alewitz | 204/197 |
| 3,907,658 | 9/1975 | Watson | 204/197 |
| 4,060,472 | 11/1977 | Alewitz | 204/197 |
| 4,093,529 | 6/1978 | Strobach | 204/197 |
| 4,113,600 | 9/1978 | Cook | 204/197 |
| 4,224,126 | 9/1980 | Bidwell | 204/197 |
| 4,286,573 | 9/1981 | Nickel | 126/362 |
| 4,773,977 | 9/1988 | Houle et al. | 204/147 |

*Primary Examiner*—T. Tung

*Attorney, Agent, or Firm*—Andrus, Sceales, Starke & Sawall

[57] ABSTRACT

An improved combination anode mount and hot water outlet for a water heater. The water heater includes a tank to contain water to be heated and the tank has an upper head with an opening therein. An annular internally threaded spud is welded to the upper surface of the head in alignment with the opening in the head. The anode mount and hot water outlet includes a tubular metal body having an upper threaded end which is threaded to the spud. A wall or closure extends transversely across the body intermediate the ends and divides the body into an upper chamber and a lower chamber. Ports are provided in the body and establish communication between the tank and the upper chamber and serve to conduct heated water from the tank. The upper end of an anode formed of a metal electronegative to steel is mounted in the lower chamber of the body and the steel core wire of the anode is welded within a hole in the transverse wall. The tubular body can be coated with a corrosion resistant metal and the portions of the body exposed to water in the tank and also be provided with an outer plastic coating.

9 Claims, 1 Drawing Sheet

COMBINATION ANODE MOUNT AND HOT WATER OUTLET FOR WATER HEATER

BACKGROUND OF THE INVENTION

A storage type water heater includes a tank to contain water to be heated. Cold water is introduced into the lower end of the tank while heated water is withdrawn from an outlet in the upper head of the tank. The water heater tank is normally composed of steel, and to prevent corrosion of the steel tank, a corrosion resistant coating, formed of vitreous enamel or plastic is normally applied to the inner surface of the tank. In practice it is difficult to completely coat certain areas of the steel tank, such as areas bordering openings in the tank or the joints between the cylindrical shell and heads of the tank. In addition, the corrosion resistant coating may contain minor imperfections. As a result, intensified corrosion can occur at the exposed steel areas of the tank.

As a consequence, it has been the practice to mount an anode formed of a metal electro-negative to steel, such as aluminum, zinc or magnesium, in the tank. The anode generally takes the form of an elongated rod and the upper end of the anode extends through an opening in the upper head of the tank and is supported from an annular spud that is welded to the outer surface of the upper head. With the use of an anode, a galvanic circuit is set up in which the anode will corrode preferentially to thereby prevent corrosion of the exposed areas of the steel tank.

However, the use of an anode normally requires a separate opening in the tank head. Therefore, it has been proposed to combine an anode mount and a hot water outlet so that only a single opening in the upper head is required. U.S. Pat. No. 4,060,472 describes a combination anode mount and hot water outlet which includes a plastic tube that extends downwardly through an opening in the upper head of the tank and the plastic tube is provided with a transverse wall that divides the tube into an upper water outlet chamber and a lower chamber. Openings are provided in the wall of the plastic tube and establish communication between the tank and the upper chamber of the tube, thereby serving to conduct heated water from the tank through the tube to the water piping system.

In the construction of the aforementioned patent, the upper end of an anode rod is mounted in the lower chamber of the plastic tube and a metal sleeve is molded in the plastic tube and provides an electrical connection between the upper end of the anode and a metal nipple which is located on the outer surface of the upper end of the plastic tube. The nipple is threaded in a stud welded to the upper head of the tank and bordering the opening in the tank.

With the construction of U.S. Pat. No. 4,060,472 the plastic tube, metal sleeve and anode are locked together by compression rolling.

It has been found that with the construction of the aforementioned patent, leakage can occur between the nipple and the plastic tube, thereby causing corrosion of the upper end of the internal metal sleeve. Similarly, leakage can also occur between the anode and the plastic tube resulting in corrosion of the lower end of the metal sleeve. Corrosion of the metal sleeve will increase the electrical resistance and thus reduce the effectiveness of the anode. In certain situations, the corrosion may be so severe that the electrical connection between the anode and the nipple is destroyed.

SUMMARY OF THE INVENTION

The invention is directed to an improved combination anode mount and hot water outlet for a storage type water heater. The combination anode mount and outlet includes a tubular metal body, preferably formed of steel, and the upper end of the body is provided with an external thread that is threaded to an annular spud which is welded to the outer surface of the tank head bordering an opening in the head.

The tubular metal body is formed with a transverse wall or closure located intermediate its ends which divides the body into an upper outlet chamber and a lower chamber. Openings are provided in the body above the transverse wall and establish communication between the tank and the upper chamber, thereby providing a passage for the discharge of heated water from the tank.

The upper end of an anode formed of a metal electronegative to steel, such as aluminum, magnesium or zinc, is press fitted into the lower chamber of the body, and the anode is provided with a steel core wire which projects upwardly beyond the end of the anode and is welded within in a hole in the transverse wall.

In one form of the invention, the wall which extends transversely across the body, is formed by punching out a pair of opposed tabs in the wall of the body. The tabs are bent transversely and are disposed in overlapping relation within the body to provide the wall. With this construction, the core wire of the anode extends through aligned openings in the tabs and is welded therein to provide a positive electrical connection between the anode and the body.

In a second form of the invention, the transverse wall is provided by securing a separate cup-shaped member in the lower end of the body. The open end of the cup-shaped member faces outwardly and receives the upper end of the anode. In this embodiment the core wire extends through a hole in the cup-shaped member and is welded therein to provide the connection between the anode and the body.

As the steel body projects downwardly into the tank and is exposed to the water therein, it is contemplated that the body can be galvanized and the portions of the body which are exposed to the water in the tank can also be provided with an electrically insulating coating, preferably formed of a plastic material, such as polypropylene, nylon or the like.

The combination anode mount and hot water outlet of the invention is of simple and inexpensive construction and yet provides a positive connection between the anode and the tank which does not rely on rolling compression as in devices used in the past.

Other objects and advantages will appear in the course of the following description.

DESCRIPTION OF THE ILLUSTRATED EMBODIMENT

Figure 1:
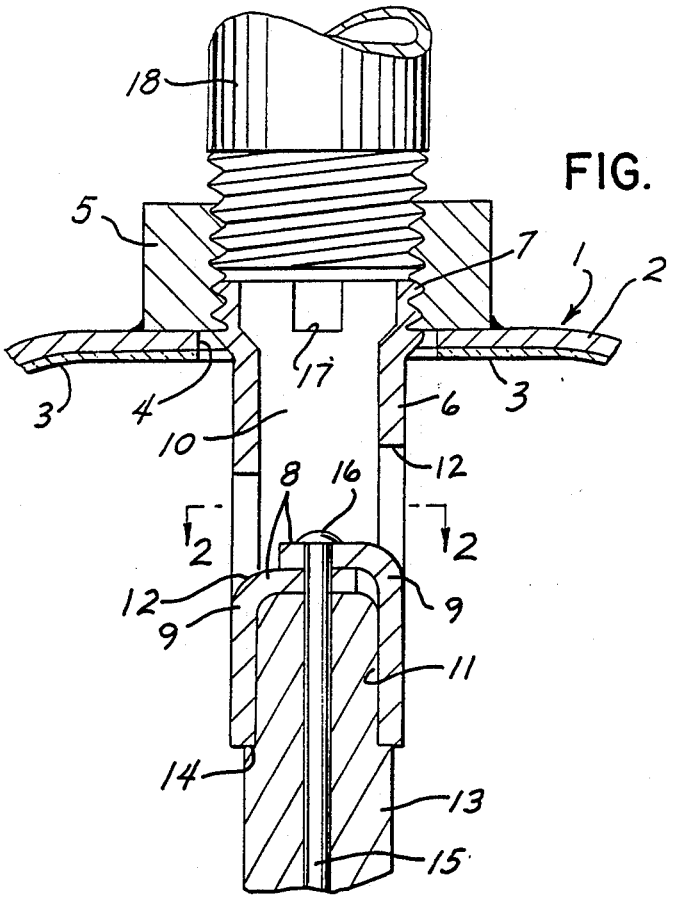
FIG. 1 is a vertical section of the combination anode mount and hot water outlet of the invention.
Figure 2:
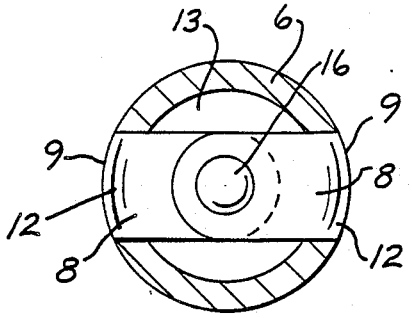
FIG. 2 is a section taken along lines 2—2 of FIG. 1.

FIGS. 1 and 2 illustrate a combination anode mount and hot water outlet for a storage type water heater. The water heater is of conventional construction and includes a steel tank 1 having an upper head 2. The internal surfaces of tank 1, including the upper head 2, are preferably coated with a corrosion resistant coating 3, such as glass or vitreous enamel.

As shown in FIG. 1, head 2 is provided with an opening 4 and an annular internally threaded spud 5 is welded to the upper surface of head 2 in alignment with opening 4.

The combination anode mount and hot water outlet of the invention includes a metal tubular body 6, preferably formed of steel, and the upper end 7 of body 6 is provided with an external thread which is engaged with spud 5 so that the body projects downwardly into the tank 1.

Opposed portions of body 6 are formed with punched in tabs 8. The lower end of each tab 8 is integrally connected to the body 6, as indicated at 9, and the tabs are bent transversely, as shown in FIG. 1, so that they are disposed in lapping relation and provide a transverse closure or wall that divides the body into an upper hot water outlet chamber 10 and a lower chamber 11.

The punched-out tabs 8 provide a pair of opposed holes or openings 12 and the holes 12 establish communication between the interior of the tank and outlet chamber 10, thus providing a passage for the discharge of heated water from the tank.

The upper end of an elongated anode rod 13 formed of a metal electro-negative to steel, such as aluminum, magnesium or zinc, is mounted within the lower chamber 11. In practice, the upper end of the anode is mashed into the chamber to provide a press-fit. As shown in FIG. 1, the outer surface of anode 13 can be provided with an annular shoulder 14 which bears against the lower end of body 6, and the shoulder can provide increased stability for the elongated anode rod.

A core wire 15 formed of steel is located centrally of anode 13 and projects upwardly beyond the end of the anode through aligned holes in the overlapping tabs 8. The upper end of wire 5 is connected to the tabs 8 of body 6 by a weld 16, thus providing a positive electrical connection between the anode and body 6. The threaded connection between the upper end of body 6 and spud 5 provides an electrical connection between body 6 and tank 1.

As shown in FIG. 1, spud 5 has a substantial depth and in order to thread body 6 into the lower portion of spud 5, the upper end of body 6 is provided with a plurality of driving notches 17 which receive a suitable tool. The lower end of a tubular nipple 18 is threaded in the upper end of spud 5 and is connected in a conventional manner to the water piping system.

To prevent corrosion of the steel body 6, the body can be plated with a metal such as zinc, copper or tin, and it is also contemplated that an electrically insulating coating, preferably formed of a plastic material, such as polypropolene or Nylon, can be applied to both the internal and external surfaces of body 6 that are exposed to the water in the tank.

Figure 4:
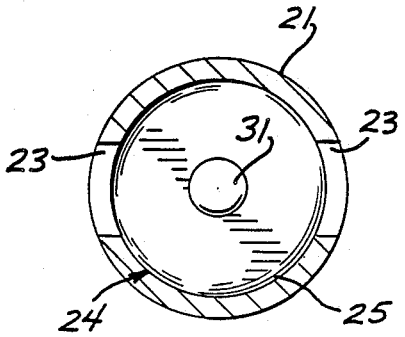
FIG. 4 is a section taken along lines 4—4 of FIG. 3.
Figure 3:
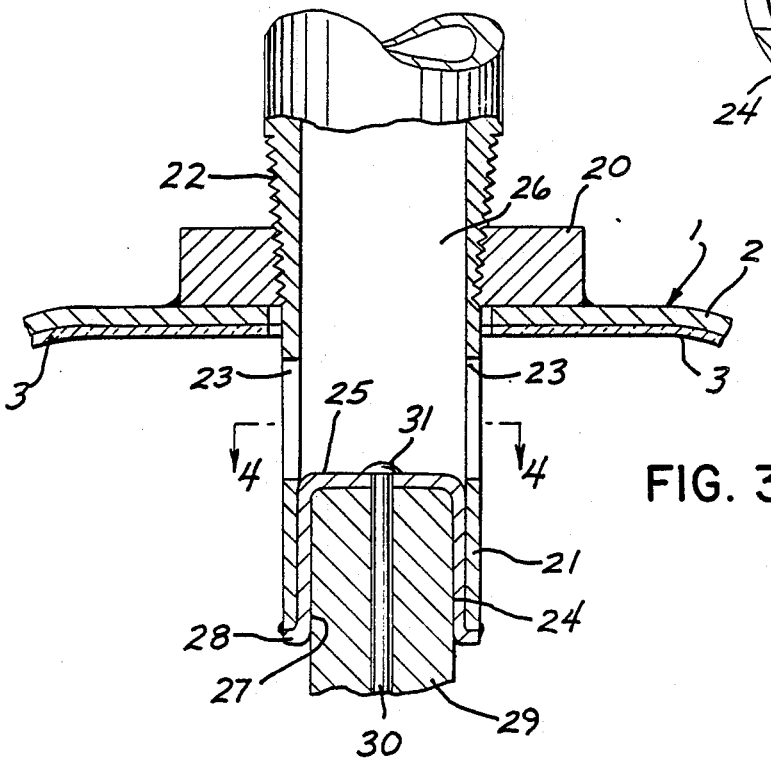
FIG. 3 is a longitudinal section of a modified form of the invention.

FIGS. 3 and 4 illustrate a modified form of the invention. In this embodiment, an annular internally threaded spud 20 is welded to the outer surface of head 2 in alignment with opening 4. In this embodiment, spud 20 has a lesser depth than spud 5 of the first embodiment.

The combination anode mount and hot water outlet comprises a metal tubular body 21, preferably formed of steel, and the upper end 22 of the body has an external thread which is connected to spud 20 so that body 21 projects downwardly into tank 1.

The central portion of body 21 is formed with a pair of opposed outlet holes 23 which provide communication between the tank 1 and the interior of the body.

An inverted, generally cup-shaped member 24 formed of a metal, such as steel, is secured within the lower end of body 21 and the end wall 25 of member 24 provides a closure dividing the body into an upper outlet chamber 26 and a lower chamber 27.

As shown in FIG. 3, the lower end of member 24 is provided with an outwardly extending flange 28 which is welded to the lower end of body 21.

The upper end of an anode 29, similar in construction and function as anode 13 of the first embodiment, is mounted within the lower chamber 27. The steel core wire 30 of anode 29 projects upwardly through a hole in end wall 25 and is secured to the end wall by a weld 31.

As in the case of the first embodiment, the body 21 and cup-shaped member 24 can be plated or otherwise coated with a corrosion resistant metal and the surfaces of these members that are exposed to the water in tank 1 can also be provided with an electrically insulating coating formed of plastic or the like, not shown in the drawings.

The invention provides a simple and inexpensive combination anode mount and hot water outlet which is associated with a single opening in the upper head, thus eliminating the expense of forming separate outlets in the upper head for both the anode mount and the hot water outlet.

The construction of the invention also provides a positive connection of the anode to the metal body, thus eliminating the problems that have arisen in the past when using a compression rolling system to connect the anode to a mounting tube.

Various modes of carrying out the invention are contemplated as being within the scope of the following claims particularly pointing out and distinctly claiming the subject matter which is regarded as the invention:

We claim:

1. In a water heater, a tank to contain water to be heated and having an upper head, said head having an opening therein, an annular spud secured to the outer surface of said head in alignment with said opening, a tubular metal body having an upper end extending through said opening and connected to said spud, said body having a pair of opposed apertures, a tab integrally connected to the bottom edge of each aperture, said tabs extending transversely of said body and disposed in lapping relation to provide a wall dividing said body into an upper chamber and a lower chamber, heated water from the tank being adapted to be discharged through said apertures to said upper chamber, and an anode of a metal electro-negative to steel having an upper end disposed in said lower chamber and in electrical contact with said body.

2. The water heater of claim 1, wherein said anode includes a central steel core wire projecting beyond the upper end of said anode, said lapping tabs having aligned holes to receive the projecting end of said core wire, sand weld means welding the projecting end of the core wire to at least one of said tabs.

3. The water heater of claim 1, and including a coating of a corrosion resistant material on the surfaces of said body exposed to water in said tank.

4. The water heater of claim 3 wherein said coating comprises a thermoplastic resin.

5. The water heater of claim 1, wherein said spud has an internal thread and the upper end of the body has an external thread engaged with the internal thread of the spud.

6. The water heater of claim 5, wherein the portion of said body extending downwardly from the upper threaded end has a smaller cross sectional area than said upper end.

7. The water heater of claim 1, wherein the axes of said apertures are offset vertically.

8. The water heater of claim 5, and including means connected to the upper end of said body for receiving a tool to thread said body to said spud.

9. In a water heater, a tank to contain water to be heated and having a wall, said wall having an opening therein, an annular spud secured to the outer surface of said wall in alignment with said opening, a tubular metal body having a generally cylindrical wall portion disposed in said opening and having an upper end connected to said spud, said wall portion having at least one aperture, a tab integrally connected to the bottom edge of said aperture and extending transversely of said wall portion and dividing said body into an upper chamber and a lower chamber, heated water from the tank being adapted to be discharged through said aperture to said upper chamber, and an anode of a metal electro-negative to steel having an upper end disposed in said lower chamber and in electrical contact with said body, said transversely extending tab being spaced form said wall portion to exposed the upper end of said anode to said upper chamber.

* * * * *

UNITED STATES PATENT AND TRADEMARK OFFICE

CERTIFICATE OF CORRECTION

PATENT NO. : 4,954,172

DATED : September 4, 1990

INVENTOR(S) : TIMOTHY H. HOULE ET AL

It is certified that error appears in the above-identified patent and that said Letters Patent is hereby corrected as shown below:

Col. 4, Line 67, CLAIM 2, Cancel "sand" and substitute therefor --and--

Signed and Sealed this

Second Day of June, 1992

*Attest:*

DOUGLAS B. COMER

*Attesting Officer*

*Acting Commissioner of Patents and Trademarks*